US005972287A

United States Patent [19]

Fujita et al.

[11] Patent Number: 5,972,287

[45] Date of Patent: Oct. 26, 1999

[54] HEAT-RESISTING STEEL

[75] Inventors: Akitsugu Fujita; Fujimitsu Masuyama; Masatomo Kamada, all of Nagasaki, Japan

[73] Assignee: Mitsubishi Heavy Industries, Ltd., Tokyo, Japan

[21] Appl. No.: 09/102,365

[22] Filed: Jun. 23, 1998

[30] Foreign Application Priority Data

Jun. 25, 1997 [JP] Japan ..... 9-168656

[51] Int. Cl.[6] ..... C22C 38/22; C22C 38/24

[52] U.S. Cl. ..... 420/38; 420/37

[58] Field of Search ..... 420/38, 37

[56] References Cited

U.S. PATENT DOCUMENTS

| | | | |
|---|---|---|---|
| 2,905,577 | 9/1959 | Harris et al. | 148/31 |
| 3,139,337 | 6/1964 | Boyle et al. . | |
| 5,560,788 | 10/1996 | Yamada et al. | 420/37 |
| 5,591,391 | 1/1997 | Igarashi et al. | 420/37 |

FOREIGN PATENT DOCUMENTS

| | | | |
|---|---|---|---|
| 0 691 416 A1 | 1/1996 | European Pat. Off. | C22C 38/18 |
| 0 703 301 A1 | 3/1996 | European Pat. Off. | C22C 38/22 |
| 0 754 774 A1 | 1/1997 | European Pat. Off. | C22C 38/30 |
| 0 767 250 A2 | 4/1997 | European Pat. Off. | C22C 38/44 |
| 0 806 490 A1 | 11/1997 | European Pat. Off. | C22C 38/30 |
| 0 767 250 A3 | 12/1997 | European Pat. Off. | C22C 38/44 |
| 1140573 | 1/1956 | France . | |
| 5-263196 | 10/1993 | Japan | C22C 38/00 |
| 09071845 | 3/1997 | Japan | C22C 38/00 |

*Primary Examiner*—Deborah Yee
*Attorney, Agent, or Firm*—Foley & Lardner

[57] ABSTRACT

Disclosed is a heat-resisting steel comprising 0.05 to 0.15% by weight of carbon, 0.01 to 0.1% by weight of silicon, 0.01 to 1% by weight of manganese, 8 to 11% by weight of chromium, 0.1 to 0.8% by weight of nickel, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities, as well as other similar heat-resisting steels. Thus, this invention provides heat-resisting steels which are 12Cr steel-based materials having excellent high-temperature strength and can be used at steam temperatures of 593° C. or above, and forged steel products such as steam turbine rotors for high-temperature use.

10 Claims, No Drawings

HEAT-RESISTING STEEL

BACKGROUND OF THE INVENTION

1. Field of the Invention

This invention relates to structural materials associated with thermal electric power plants requiring the use of a heat-resisting steel. More particularly, it relates to steam turbine rotors for use in thermal electric power generation, and forged steel products for use in electric power generation.

2. Description of the Related Art

Among heat-resisting steels used in steam turbine plants for electric power generation, high-temperature turbine rotor materials include CrMoV steel and 12Cr steel. Of these, the use of CrMoV steel is restricted to plants having a steam temperature up to 566° C. because of its limited high-temperature strength. On the other hand, rotor materials based on 12Cr steel (e.g., those disclosed in Japanese Patent Publication (JP-A) No. 40-4137/'65 and the like) have more excellent high-temperature strength than CrMoV steel and can hence be used in plants having a steam temperature up to 593° C. However, if the steam temperature exceeds 593° C., such rotor materials have insufficient high-temperature strength and can hardly be used for steam turbine rotors.

Now, 12Cr steel is explained in greater detail. The term "12Cr steel" refers to a group of materials which originated from a heat-resisting steel developed in England and actually having a Cr content of 12%. In the composition of this group of materials, the contents of alloying elements have been increased every year in order to improve high-temperature strength, and the segregation of alloying elements has become manifest as the size of stocks is increased. For these and others reasons, the present situation is such that the formation of δ-ferrite may occur unless the content of Cr is reduced. Although the content of Cr may recently be as low as about 8%, this group of materials is nominally designated by "12Cr steel" in its broad sense, because the content of Cr was 12% at the initial stage of development. However, the actual content of Cr in these materials ranges from 8 to 13%. Among these materials, those having a Cr content of 9% or less may be also referred to as "9%Cr steel".

SUMMARY OF THE INVENTION

Accordingly, an object of the present invention is to provide heat-resisting steels which are 12Cr steel-based materials having excellent high-temperature strength and can be used at steam temperatures of 593° C. or above, and forged steel products such as steam turbine rotors for high-temperature use.

To this end, the present inventors made intensive investigations and have now found the following excellent heat-resisting steels.

That is, the present invention provides:

(1) A heat-resisting steel comprising 0.05 to 0.15% by weight of carbon, 0.01 to 0.1% by weight of silicon, 0.01 to 1% by weight of manganese, 8 to 11% by weight of chromium, 0.1 to 0.8% by weight of nickel, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities.

(2) A heat-resisting steel comprising 0.05 to 0.15% by weight of carbon, 0.01 to 0.1% by weight of silicon, 0.01 to 0.1% by weight of manganese, 8 to 11% by weight of chromium, 0.1 to 0.8% by weight of nickel, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities.

(3) A heat-resisting steel comprising 0.05 to 0.15% by weight of carbon, 0.01 to 0.1% by weight of silicon, 0.01 to 1% by weight of manganese, 8 to 11% by weight of chromium, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities.

(4) A heat-resisting steel comprising 0.05 to 0.15% by weight of carbon, 0.01 to 0.1% by weight of silicon, 0.01 to 0.1% by weight of manganese, 8 to 11% by weight of chromium, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities.

Moreover, the present invention provides (5) a heat-resisting steel as described in any of (1) to (4) which further comprises 0.001 to 0.2% by weight of neodymium, (6) a heat-resisting steel as described in any of (1) to (4) which further comprises 0.001 to 0.2% by weight of hafnium, and (7) a heat-resisting steel as described in (6) which further comprises 0.001 to 0.2% by weight of neodymium.

The present invention provides excellent heat-resisting steels which have not been known in the prior art. As a result, it becomes possible to raise the service temperatures of various structural members used in electric power plants. Especially when the materials of the present invention are applied to the manufacture of steam turbine rotors for high-temperature use, they have excellent high-temperature strength and are hence suitable for use in ultra supercritical pressure power plants having a steam temperature higher than 593° C. On the basis of these results, it may be said that, if the materials of the present invention are applied to the manufacture of various structural members used in electric power plants, they are useful in further raising the operating temperature of the current ultra supercritical pressure power plants to afford a saving of fossil fuels and, moreover, to reduce the amount of carbon dioxide evolved.

DETAILED DESCRIPTION OF THE PREFERRED EMBODIMENTS

The present inventors made intensive investigations in order to improve high-temperature strength by using a high-Cr steel as a basic material and controlling the contents and the kinds of alloying elements strictly, and have now discovered new heat-resisting steels have excellent high-temperature strength characteristics which have not been observed in conventional materials.

As a first preferred embodiment, the present invention proposes a heat-resisting steel comprising 0.05 to 0.15% by weight of carbon, 0.01 to 0.1% by weight of silicon, 0.01 to 1% by weight of manganese, 8 to 11% by weight of chromium, 0.1 to 0.8% by weight of nickel, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities.

The reasons for content restrictions in the aforesaid heat-resisting steels of the present invention are described below.

C (carbon) forms carbides and thereby contributes to the improvement of creep rupture strength. In conventionally used 12Cr type steels, N is added together with C to form carbonitrides and thereby achieve an improvement in high-temperature strength. However, in the heat-resisting steels of the present invention, N is basically eliminated and an improvement in high-temperature strength is achieved by the formation of carbides, so that the content of C is higher than in conventional 12Cr type steels. If the content of C is less than 0.05% by weight, no sufficient effect may be produced by the formation of carbides, while if it is greater than 0.15% by weight, the carbides may aggregate during use to form coarse grains, resulting in a reduction in long-time high-temperature strength. Accordingly, the content of C should be in the range of 0.05 to 0.15% by weight. The preferred range is from 0.08 to 0.13% by weight.

Si (silicon) is effective as a deoxidizer. If its content is less than 0.01% by weight, no sufficient effect may be produced in this respect. Moreover, Si causes a reduction in high-temperature strength and, in particular, creep rupture strength. Consequently, with concurrent consideration for the fact that the steels of the present invention may be subjected to a vacuum treatment (e.g., a vacuum carbon deoxidation process) as required, Si should be added in a minimum amount required for steel making. Thus, the content of Si should be in the range of 0.01 to 0.1% by weight. The preferred range is from 0.03 to 0.08% by weight.

Mn (manganese) is an element which is also useful as a deoxidizer. Moreover, Mn has the effect of inhibiting the formation of δ-ferrite. On the other hand, the addition of a large amount of this element will cause a reduction in creep rupture strength. Consequently, the addition of more than 1% by weight of Mn is undesirable. Furthermore, Mn also reacts with S incorporated as an impurity to form MnS and thereby serves to negate the adverse effect of S. However, with consideration for forging at the stage of steel making, an Mn content of not less than 0.1% by weight is advantageous from the viewpoint of cost because this makes scrap control easy. Accordingly, the content of Mn should be in the range of 0.1 to 1% by weight.

Cr (chromium) forms a carbide and thereby contributes to the improvement of creep rupture strength. Moreover, Cr dissolves in the matrix to improve oxidation resistance and also contributes to the improvement of long-time high-temperature strength by strengthening the matrix itself. If its content is less than 8% by weight, no sufficient effect may be produced. On the other hand, if its content is greater than 11% by weight, the formation of δ-ferrite will tend to occur and cause a reduction in strength and toughness, though this may depend on other alloying elements. Accordingly, the content of Cr should be in the range of 8 to 11% by weight. The preferred range is from 9.5 to 10.8% by weight.

Ni (nickel) is an element which is effective in improving toughness. Moreover, Ni also has the effect of reducing the Cr equivalent and thereby inhibiting the formation of δ-ferrite. However, since the addition of this element may cause a reduction in creep rupture strength, it is desirable to add Ni in a required minimum amount. In the present invention, Co is added as an element for exhibiting the effects of Ni, so that the role of Ni can be performed by Co. However, since Co is an expensive element, it is necessary from an economic point of view to reduce the content of Co as much as possible. Consequently, the formation of δ-ferrite is inhibited by adding not greater than 0.8% by weight of Ni, though this may depend on other alloying elements. Its lower limit is determined to be 0.1% by weight with consideration for the amount of Ni which is usually incorporated as an incidental impurity. Accordingly, the content of Ni should be in the range of 0.1 to 0.8% by weight.

V (vanadium) forms a carbonitride and thereby improves creep rupture strength. If its content is less than 0.1% by weight, no sufficient effect may be produced. On the other hand, if its content is greater than 0.3% by weight, the creep rupture strength may contrarily be reduced. Moreover, a reduction in toughness will also be caused. Accordingly, the content of V should be in the range of 0.1 to 0.3% by weight. The preferred range is from 0.15 to 0.25% by weight.

Nb (niobium) and Ta (tantalum) form carbonitrides and thereby contribute to the improvement of high-temperature strength. In the steels of the present invention, the content of N is limited and, therefore, they form principally carbides. Moreover, they cause finer carbides ($M_{23}C_6$) to precipitate at high temperatures and thereby contribute to the improvement of long-time creep rupture strength. If their total content is less than 0.01% by weight, no beneficial effect may be produced. On the other hand, if their total content is greater than 0.2% by weight, the carbides of Nb and Ta formed during the manufacture of steel ingots will fail to dissolve fully in the matrix during heat treatment (solution treatment at 980 to 1,150° C.) and may coarsen during use to cause a reduction in long-time creep rupture strength. Accordingly, the total content of Nb and Ta should be in the range of 0.01 to 0.2% by weight. The preferred range is from 0.03 to 0.07% by weight.

N (nitrogen), together with C and alloying elements, forms carbonitrides and thereby contributes to the improvement of high-temperature strength. However, as described previously, the heat-resisting steel of the present invention is a material in which high-temperature strength is enhanced not by the precipitation of carbonitrides but by the precipitation of carbides alone. In this respect, the present invention significantly different from the prior art. Consequently, N is an impurity which must be minimized. The reason why N is considered to be an impurity in the present steel as contrasted with the prior art is that, as will be described later, the addition of B is more effective in improving high-temperature strength than the precipitation of carbonitrides. In steel, N combines easily with B to form a nonmetallic inclusion, BN. Consequently, in steel containing N, the effect of B added thereto is negated by N and, therefore, B fails to bring about a sufficient improvement in high-temperature strength. Thus, in sharp contrast to conventional materials, N is not particularly added to the heat-resisting steel of the present invention. On the contrary, a vacuum treating process or the like may be employed to remove any N introduced from the atmosphere as much as possible. If the content of N is greater than 0.01% by weight, N may combine with B as described above and prevent B from producing a sufficient effect. However, if it is reduced to 0.01% by weight or less, B in solid solution acts effectively and thereby contributes to the improvement of high-temperature strength. Accordingly, the allowable content of N is up to 0.01% by weight.

Mo (molybdenum), together with W (tungsten), dissolves in the matrix and thereby improves creep rupture strength. If Mo is added alone, it may be used in an amount of about 1.5% by weight. However, where W is also added as is the case with the materials of the present invention, W is more effective in improving high-temperature strength. Moreover, if Mo and W are added in unduly large amounts, δ-ferrite may be formed to cause a reduction in creep rupture strength. Consequently, with consideration for a balance with the content of W, the content of Mo should be not greater than 0.5% by weight. Furthermore, since the addition of W alone fails to give sufficient high-temperature strength, at least a slight amount of Mo needs to be added. That is, the content of Mo should be not less than 0.01% by weight. Accordingly, the content of Mo should be in the range of 0.01 to 0.5% by weight. The preferred range is from 0.1 to 0.25% by weight.

As described above, W, together with Mo, dissolves in the matrix and thereby improves creep rupture strength. W is an element which exhibits a more powerful solid solution strengthening effect than Mo and is hence effective in improving high-temperature strength. However, if W is added in unduly large amounts, δ-ferrite and a large amount of Laves phase will be formed to cause a reduction in creep rupture strength. Accordingly, with consideration for a balance with the content of Mo, the content of W should be in the range of 0.9 to 3.5% by weight. The preferred range is from 1.5 to 2.8% by weight.

Co (cobalt) dissolves in the matrix to inhibit the formation of δ-ferrite. However, Co does not reduce high-temperature strength as contrasted with Ni. Consequently, if Co is added, strengthening elements (e.g., Cr, W and Mo) may be added in larger amounts than in the case where no Co is added. As a result, high creep rupture strength can be achieved. In addition, Co also has the effect of enhancing resistance to temper softening and is hence effective in minimizing the softening of the material during use. These effects are manifested by adding Co in an amount of not less than 0.1% by weight, though it may depend on the contents of other elements. However, in the component system of the heat-resisting steel of the present invention, the addition of more than 4.5% by weight of Co tends to induce the formation of intermetallic compounds such as σ phase. Once such intermetallic compounds are formed, the material may become brittle. In addition, this will also lead to a reduction in long-time creep rupture strength. Accordingly, the content of Co should be in the range of 0.1 to 4.5% by weight. The preferred range is from 2 to 4% by weight.

B (boron) has the effect of enhancing grain boundary strength and thereby contributes to the improvement of creep rupture strength. In particular, the steel of the present invention is a material designed so that the aforesaid effect of B will be exhibited to the utmost extent. To this end, the content of N which inhibits the effect of B is restricted as described previously, in order that B added thereto may function properly. However, if B is added in unduly large amounts, the hot workability may be worsened and, moreover, the toughness may be reduced. On the other hand, if the content of B is less than 0.001% by weight, it may fail to produce a sufficient effect. Accordingly, the content of B should be in the range of 0.001 to 0.01% by weight. The preferred range is from 0.003 to 0.007% by weight.

As a second preferred embodiment, the present invention proposes a heat-resisting steel comprising 0.05 to 0.15% by weight of carbon, 0.01 to 0.1% by weight of silicon, 0.01 to 0.1% by weight of manganese, 8 to 11% by weight of chromium, 0.1 to 0.8% by weight of nickel, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities.

The reasons for content restrictions in the aforesaid heat-resisting steel of the present invention are described below. However, except for Mn, the reasons are the same as those described in connection with the first embodiment and are hence omitted. Here, the reason why the content of Mn is restricted to a narrower range is explained. As described in connection with the first embodiment, Mn is an element which is useful as a deoxidizer. Moreover, Mn has the effect of inhibiting the formation of δ-ferrite. However, as described previously, the addition of this element causes a reduction in creep rupture strength similarly to Ni. Consequently, it is necessary to minimize the content of Mn. Especially if the content of Mn is restricted to 0.1% by weight or less, the creep rupture strength is markedly improved. Furthermore, Mn also reacts with S incorporated as an impurity to form MnS and thereby serves to negate the adverse effect of S. For this reason, it is necessary to add Mn in an amount of not less than 0.01% by weight. Accordingly, the content of Mn is restricted to a range of 0.01 to 0.1% by weight.

As a third preferred embodiment, the present invention proposes a heat-resisting steel comprising 0.05 to 0.15% by weight of carbon, 0.01 to 0.1% by weight of silicon, 0.01 to 1% by weight of manganese, 8 to 11% by weight of chromium, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities.

The reasons for content restrictions in the aforesaid heat-resisting steel of the present invention are as follows. The composition of the third embodiment is the same as that of the first embodiment, except that no Ni (nickel) is added in contrast to the first and second embodiments. Accordingly, only the reason for omission of Ni is explained.

As described in connection with the first and second embodiments, Ni has the effect of dissolving in the matrix to inhibit the formation of δ-ferrite. In addition, Ni is effective in improving toughness. However, as described previously, the addition of Ni will cause a reduction in creep rupture strength. Consequently, it is necessary to minimize the content of Ni. In the rotor material of the present invention, the effects of Ni (e.g., an improvement in toughness) can be exhibited by adding Co in place of Ni. Consequently, the addition of Ni exerting an adverse influence on creep rupture strength can be omitted by adding properly selected elements (e.g., Co, C and N) so as to prevent the formation of δ-ferrite. This omission of Ni makes it possible to achieve a much higher creep rupture strength as compared with rotor materials containing Ni. Thus, the composition of this heat-resisting steel should be such that, although the presence of Ni introduced from raw materials as an impurity is permitted, Ni is basically eliminated without adding any Ni thereto.

As a fourth preferred embodiment, the present invention proposes a heat-resisting steel comprising 0.05 to 0.15% by weight of carbon, 0.01 to 0.1% by weight of silicon, 0.01 to 0.1% by weight of manganese, 8 to 11% by weight of chromium, 0.1 to 0.3% by weight of vanadium, a combined amount of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, and the balance being iron and incidental impurities.

The reasons for content restrictions in the aforesaid heat-resisting steel of the present invention are as follows. The composition of the fourth embodiment is based on the composition of the first embodiment, except that the content of Mn is restricted to a narrower range for the reason described in connection with the second embodiment and the addition of Ni is omitted for the reason described in connection with the third embodiment. Accordingly, the reasons for content restrictions in the fourth embodiment have already been described in connection with the first to third embodiments and are hence omitted here.

As a fifth preferred embodiment, the present invention proposes a heat-resisting steel in accordance with any of the first to fourth embodiments which further comprises 0.001 to 0.2% by weight of neodymium.

The reasons for content restrictions in the aforesaid heat-resisting steel of the present invention are described below. However, the reasons which have been described in connection with the first to fourth embodiments are omitted. Here, the reason why Nd (neodymium) is newly added as contrasted with the first to fourth embodiments is explained.

Nd forms a carbide and a nitride which are finely dispersed into the matrix to improve high-temperature strength and, in particular, creep rupture strength. Moreover, it is believed that some Nd dissolves in the matrix and thereby contributes to solid solution strengthening. These effects are useful even when an extremely small amount of Nd is added. In fact, these effects are observed even at an Nd content of 0.001% by weight. However, the addition of an unduly large amount of Nd may detract from the toughness of the material and thereby embrittle it. Accordingly, the content of Nd should be not greater than 0.2% by weight. The preferred range is from 0.005 to 0.015% by weight.

As a sixth preferred embodiment, the present invention proposes a heat-resisting steel in accordance with any of the first to fourth embodiments which further comprises 0.001 to 0.2% by weight of hafnium.

The reasons for content restrictions in the aforesaid heat-resisting steel of the present invention are described below. However, the reasons which have been described in connection with the first to fourth embodiments are omitted. Here, the reason why Hf (hafnium) is newly added as contrasted with the first to fourth embodiments is explained.

Hf is an alloying element which is added to nickel-base superalloys and the like, and is highly effective in enhancing grain boundary strength to bring about an improvement in high-temperature strength and, in particular, creep rupture strength. This effect of Hf is also useful in the rotor materials of the present invention which comprise high-Cr steels. That is, as described above, Hf is highly effective in improving creep rupture strength. In addition to the above-described effect, Hf has the effect of improving the long-time creep rupture strength of high-Cr steels, for example, by dissolving in the matrix to strengthen the matrix itself, retarding the aggregation and coarsening of carbides, and forming a fine carbide and thereby contributing to precipitation strengthening. These effects are useful even when an extremely small amount of Hf is added. In fact, these effects are observed even at an Hf content of 0.001% by weight. However, the addition of an unduly large amount of Hf will detract from the toughness of the material and thereby embrittle it. Moreover, if more than 0.2% by weight of Hf is added, it may fail to dissolve in the matrix during preparation, so that no additional effect cannot be expected. In addition, such a large amount of Hf will react with the refractories to form inclusions, thus reducing the purity of the material itself and causing damage to the melting furnace. Consequently, Hf must be added in a required minimum amount. For the above-described reasons, the content of Hf should be in the range of 0.001 to 0.2% by weight. The preferred range is from 0.005 to 0.015% by weight.

As a seventh preferred embodiment, the present invention proposes a heat-resisting steel in accordance with the sixth embodiment which further comprises 0.001 to 0.2% by weight of neodymium.

The reasons for content restrictions in the aforesaid heat-resisting steel of the present invention are as follows. The composition of the seventh embodiment is based on the composition of the first and the fourth embodiment, except that Nd is added for the reason described in connection with the fifth embodiment and Hf is added for the reason described in connection with the sixth embodiment. Accordingly, the reasons for content restrictions in the seventh embodiment have already been described in connection with the first to sixth embodiments and are hence omitted here.

In addition to the above-described components, the heat-resisting steels of the present invention comprise iron and incidental impurities.

The term "incidental impurities" refers to elements which are introduced from raw materials at the stage of steel making and cannot be removed by refining. Specifically, they include P, S, Al, O, Sn, As and Sb. The contents of incidental impurities are as follows: P<0.03, S<0.03, Al<0.01, O<0.01, Sn<0.01, As<0.01 and Sb<0.01.

Thus, the heat-resisting steels of the present invention can be used at steam temperatures of 593° C. or above, have excellent high-temperature strength, and are hence suitable for use as structural materials associated with thermal electric power plants. In particular, they are suitable for the manufacture of steam turbine rotors for thermal electric power generation and forged steel products for electric power generation.

Now, the present invention is more specifically explained with reference to the following examples.

In these examples, experiments were conducted by using steam turbine rotors as typical examples because they have the largest size of all forged steel products used in electric power plants. When simulation tests are performed with forged steel products (i.e., steam turbine rotors) having the largest size, other forged steel products having smaller sizes (i.g., small-sized parts such as valve bodies) are expected to exhibit better properties than steam turbine rotors. Accordingly, it is believed that, by evaluating heat-resisting materials as steam turbine rotor materials, their usefulness for other small-sized forged steel products can be satisfactorily evaluated.

EXAMPLE 1

Example 1 is an example concerned with the first embodiment of the present invention.

The chemical compositions of materials used for testing purposes are summarized in Table 1.

The mechanical properties and creep rupture strengths of inventive materials (1) and comparative materials are shown in Table 2. Although there is little difference in the results of room-temperature tension tests, the elongation and reduction in area of some comparative materials (i.e., material Nos. 8, 9, 12, 13 and 18–20) are somewhat lower than those of other materials. With respect to impact properties, some comparative materials (i.e., material Nos. 6, 8, 9, 13–15 and 17–20) show lower values, revealing that the toughness of these comparative materials is lower than that of the inventive materials. Moreover, this table also shows the rupture times obtained in creep rupture tests performed at a test temperature of 650° C. and a stress of 18 kgf/mm$^2$. It is evident from these results that the creep rupture strength of the inventive materials is much more excellent than that of all comparative materials except one.

EXAMPLE 2

The chemical compositions of materials used for testing purposes are summarized in Table 3. The compositions of inventive materials (2) are based on the compositions of the inventive materials used in Example 1 (i.e., the inventive materials (1)). That is, material No. 21 was obtained by reducing the content of Mn in material No. 1, and material No. 22 was obtained by reducing the content of Mn in material No. 2. Similarly, the compositions of other inventive materials (2) were determined on the basis of the compositions of the corresponding inventive materials (1). It is to be understood that, except for Mn, the compositions aimed at in the melting process for the preparation of the inventive materials (2) were the same as those of the respective inventive materials (1), though the actual compositions varied slightly with the melting process.

The mechanical properties and creep rupture strengths of the inventive materials (2) and the inventive materials of Example 1 (i.e., the inventive materials (1)) used for comparative purposes are shown in Table 4. It is evident from this table that there is little difference in the results of room-temperature tension tests. With respect to impact properties, some inventive materials (2) show slightly lower impact values than the corresponding inventive materials (1), because they have a lower Mn content. However, such reductions are slight and unworthy of serious consideration. On the other hand, a comparison of the creep rupture strengths reveals that the inventive materials (2) show an increase in rupture time over the respective inventive materials (1), indicating a distinct improvement in creep rupture strength.

EXAMPLE 3

The chemical compositions of materials used for testing purposes are summarized in Table 5. Similarly to the inventive materials (2), the compositions of inventive materials (3) are based on the compositions of the inventive materials (1), except that Ni is completely eliminated from the inventive materials (1). Specifically, material No. 31 was obtained by eliminating Ni from material No. 1. Similarly, the compositions of other inventive materials (3) were determined on the basis of the compositions of the corresponding inventive materials (1). As described in Example 2, it is to be understood that, except for Ni, the compositions aimed at in the melting process for the preparation of the inventive materials (3) were the same as those of the respective inventive materials of Example 1, though the actual compositions varied slightly with the melting process.

The mechanical properties and creep rupture strengths of the inventive materials (3) and the inventive materials of Example 1 (i.e., the inventive materials (1)) used for comparative purposes are shown in Table 6. It is evident from this table that there is little difference in the results of room-temperature tension tests. With respect to impact properties, some inventive materials (3) show slightly lower impact values than the corresponding inventive materials (1), because they have a lower Ni content. However, similarly to the inventive materials (2) having a lower Mn content, such reductions are slight and unworthy of serious consideration. On the other hand, a comparison of the creep rupture strengths reveals that, as a result of the elimination of Ni, the inventive materials (3) show a distinct improvement in creep rupture strength over the respective inventive materials (1).

EXAMPLE 4

The chemical compositions of materials used for testing purposes are summarized in Table 7. The compositions of inventive materials (4) are based on the compositions of the inventive materials (2), except that Ni is completely eliminated from the inventive materials (2). Specifically, material No. 41 was obtained by eliminating Ni from material No. 21. Similarly, the compositions of other inventive materials (4) were determined on the basis of the compositions of the corresponding inventive materials (2). As described in Examples 2 and 3, it is to be understood that, except for Ni, the compositions aimed at in the melting process for the preparation of the inventive materials (4) were the same as those of the respective inventive materials of Example 2, though the actual compositions varied slightly with the melting process.

The mechanical properties and creep rupture strengths of the inventive materials (4) and the inventive materials of Example 2 (i.e., the inventive materials (2)) used for comparative purposes are shown in Table 8. It is evident from this table that there is little difference in the results of room-temperature tension tests and impact tests. On the other hand, a comparison of the creep rupture strengths reveals that, as a result of the elimination of Ni, the inventive materials (4) show a distinct improvement in creep rupture strength over the respective inventive materials (2).

EXAMPLE 5

The chemical compositions of materials used for testing purposes are summarized in Table 9. The compositions of inventive materials (5) are based on the compositions of inventive materials (1) to (4), except that a very small amount of Nd is added to the respective materials. Specifically, material Nos. 51 and 52 were obtained by adding Nd to material Nos. 1 and 2, respectively. Similarly, material Nos. 53, 54, 55, 56, 57 and 58 were obtained by adding Nd to material Nos. 22, 23, 33, 34, 44 and 45, respectively. As described in Examples 2 to 4, it is to be understood that, except for Nd, the compositions aimed at in the melting process for the preparation of the inventive materials (5) were the same as those of the respective inventive materials of Examples 1 to 4, though the actual compositions varied slightly with the melting process.

The mechanical properties and creep rupture strengths of the inventive materials (5) and the inventive materials of Examples 1 to 4 (i.e., the inventive materials (1) to (4)) used for comparative purposes are shown in Table 10. It is evident from this table that the addition of Nd caused slight reductions in ductility and toughness, but they are unworthy of serious consideration. On the other hand, a comparison of the creep rupture strengths reveals that, as a result of the addition of a very small amount of Nd, the inventive materials (5) show a distinct improvement in creep rupture strength over the respective inventive materials (1) to (4).

EXAMPLE 6

The chemical compositions of materials used for testing purposes are summarized in Table 11. The compositions of inventive materials (6) are based on the compositions of inventive materials (1) to (4), except that a very small amount of Hf is added to the respective materials. Specifically, material Nos. 61 and 62 were obtained by adding Nd to material Nos. 1 and 2, respectively. Similarly, material Nos. 63, 64, 65, 66, 67 and 68 were obtained by adding Hf to material Nos. 22, 23, 33, 34, 44 and 45, respectively. As described in Examples 2 to 5, it is to be understood that, except for Hf, the compositions aimed at in the melting process for the preparation of the inventive materials (6) were the same as those of the respective inventive materials of Examples 1 to 4, though the actual compositions varied slightly with the melting process.

The mechanical properties and creep rupture strengths of the inventive materials (6) and the inventive materials of Examples 1 to 4 (i.e., the inventive materials (1) to (4)) used for comparative purposes are shown in Table 12. It is evident from this table that, similarly to the addition of Nd, the addition of Hf caused slight reductions in ductility and toughness, but they are unworthy of serious consideration. On the other hand, a comparison of the creep rupture strengths reveals that, as a result of the addition of a very small amount of Hf, the inventive materials (6) show a distinct improvement in creep rupture strength over the respective inventive materials (1) to (4), in the same manner as in Example 5 involving the addition of Nd.

EXAMPLE 7

The chemical compositions of materials used for testing purposes are summarized in Table 13. The compositions of inventive materials (7) are based on the compositions of inventive materials (1) to (4), except that very small amounts of Hf and Nd are added to the respective materials. Specifically, material Nos. 71 and 72 were obtained by adding Nd and Hf to material Nos. 1 and 2, respectively. Similarly, material Nos. 73, 74, 75, 76, 77 and 78 were obtained by adding Nd and Hf to material Nos. 22, 23, 33, 34, 44 and 45, respectively. As described in Examples 2 to 6, it is to be understood that, except for Nd and Hf, the compositions aimed at in the melting process for the preparation of the inventive materials (7) were the same as those of the respective inventive materials of Examples 1 to 4, though the actual compositions varied slightly with the melting process.

The mechanical properties and creep rupture strengths of the inventive materials (7) and the inventive materials of Examples 1 to 4 (i.e., the inventive materials (1) to (4)) used for comparative purposes are shown in Table 14. It is evident from this table that the combined addition of Nd and Hf caused slight reductions in ductility and toughness, but they are unworthy of serious consideration. Rather, it can be seen that the inventive materials (7) show a marked improvement in creep rupture strength.

TABLE 1

| Material No. | C | Si | Mn | Cr | Ni | V | Nb | Ta | Mo | W | Co | N | B |
|---|---|---|---|---|---|---|---|---|---|---|---|---|---|
| Inventive materials (1) | | | | | | | | | | | | | |
| 1 | 0.12 | 0.05 | 0.65 | 10.2 | 0.68 | 0.21 | 0.05 | — | 0.35 | 2.7 | 3.0 | 0.005 | 0.005 |
| 2 | 0.14 | 0.08 | 0.86 | 10.5 | 0.75 | 0.25 | 0.02 | 0.04 | 0.10 | 3.4 | 3.5 | 0.008 | 0.002 |
| 3 | 0.06 | 0.04 | 0.40 | 8.4 | 0.50 | 0.14 | 0.10 | 0.05 | 0.25 | 2.2 | 4.2 | 0.004 | 0.009 |
| 4 | 0.14 | 0.05 | 0.45 | 9.2 | 0.30 | 0.20 | — | 0.09 | 0.15 | 2.0 | 0.3 | 0.002 | 0.007 |
| 5 | 0.12 | 0.04 | 0.92 | 10.8 | 0.15 | 0.29 | 0.10 | 0.08 | 0.45 | 1.0 | 2.5 | 0.005 | 0.006 |
| Comparative materials | | | | | | | | | | | | | |
| 6 | 0.16 | 0.05 | 0.65 | 11.2 | 0.85 | 0.05 | 0.05 | — | 0.55 | 3.2 | 2.0 | 0.006 | 0.006 |
| 7 | 0.12 | 0.15 | 0.51 | 10.5 | 0.95 | 0.35 | — | 0.08 | 0.30 | 2.5 | 3.1 | 0.007 | 0.005 |
| 8 | 0.18 | 0.04 | 0.54 | 7.7 | 0.75 | 0.21 | 0.10 | 0.11 | 0.20 | 3.0 | — | 0.006 | 0.006 |
| 9 | 0.14 | 0.21 | 0.43 | 10.2 | 0.60 | 0.34 | — | — | 0.15 | 2.8 | 3.2 | 0.005 | 0.005 |
| 10 | 0.04 | 0.04 | 0.32 | 9.4 | 1.02 | 0.18 | — | — | 0.45 | 2.7 | 2.5 | 0.012 | 0.002 |
| 11 | 0.12 | 0.05 | 1.15 | 8.4 | 1.23 | 0.20 | 0.05 | — | 0.81 | 2.8 | 3.1 | 0.006 | 0.003 |
| 12 | 0.10 | 0.05 | 0.65 | 10.2 | 1.54 | 0.21 | 0.08 | — | 0.42 | 1.8 | — | 0.005 | 0.015 |
| 13 | 0.11 | 0.07 | 1.45 | 10.7 | 0.25 | 0.08 | 0.02 | 0.15 | 0.65 | 3.4 | 2.8 | 0.006 | 0.006 |
| 14 | 0.14 | 0.06 | 1.31 | 9.6 | 0.24 | 0.05 | — | 0.10 | 0.25 | 1.6 | 4.9 | 0.004 | 0.005 |
| 15 | 0.08 | 0.04 | 0.53 | 12.1 | 0.23 | 0.20 | 0.08 | 0.15 | 0.26 | 1.8 | 6.0 | 0.005 | 0.004 |
| 16 | 0.04 | 0.05 | 0.54 | 10.8 | 0.85 | 0.18 | 0.05 | — | — | 2.5 | 3.0 | 0.006 | — |
| 17 | 0.11 | 0.03 | 0.55 | 10.5 | 0.85 | 0.20 | 0.06 | — | 0.41 | 0.5 | 6.5 | 0.032 | 0.005 |
| 18 | 0.17 | 0.05 | 0.78 | 11.4 | 0.45 | 0.22 | 0.04 | — | 0.32 | 2.5 | 1.4 | 0.025 | 0.015 |
| 19 | 0.14 | 0.07 | 0.31 | 9.5 | 0.50 | 0.21 | — | — | 0.14 | 0.7 | 1.5 | 0.007 | 0.004 |
| 20 | 0.04 | 0.06 | 0.35 | 7.5 | 0.36 | 0.22 | — | 0.10 | 0.41 | 0.8 | 2.0 | 0.015 | 0.004 |

The shaded divisions indicate that the values given therein are outside the compositional range of the present invention.

TABLE 2

| Material No. | | Room-temperature tensile test: 0.2% yield strength (kgf/mm$^2$) | Tensile strength (kgf/mm$^2$) | Elongation (%) | Reduction of area (%) | 2 mm V-notched Impact test Impact value (20° C.) (kgf-m) | Creep rupture test Test conditions: 650° C., 18 kgf/mm$^2$ (hours) |
|---|---|---|---|---|---|---|---|
| Inventive materials (1) | 1 | 75.2 | 91.0 | 22.3 | 67.5 | 11.2 | 1652 |
| | 2 | 75.6 | 91.2 | 21.8 | 68.8 | 10.4 | 1826 |
| | 3 | 74.7 | 89.7 | 23.4 | 69.8 | 12.8 | 1675 |
| | 4 | 76.2 | 92.1 | 22.5 | 68.8 | 10.8 | 1250 |
| | 5 | 74.3 | 90.4 | 22.4 | 67.6 | 11.2 | 1604 |
| Comparative materials | 6 | 75.4 | 91.3 | 22.1 | 68.8 | 5.3 | 621 |
| | 7 | 76.6 | 92.2 | 23.4 | 69.8 | 10.2 | 584 |
| | 8 | 74.8 | 90.2 | 19.2 | 60.4 | 4.8 | 958 |
| | 9 | 73.2 | 89.8 | 14.2 | 48.2 | 1.3 | 612 |
| | 10 | 74.4 | 89.9 | 22.2 | 67.3 | 11.4 | 583 |
| | 11 | 76.2 | 91.4 | 23.4 | 68.8 | 10.1 | 411 |
| | 12 | 75.3 | 91.2 | 18.2 | 60.0 | 9.3 | 405 |
| | 13 | 75.3 | 91.6 | 17.6 | 58.8 | 1.2 | 535 |
| | 14 | 76.6 | 92.3 | 22.4 | 67.4 | 6.3 | 620 |
| | 15 | 74.2 | 90.6 | 12.3 | 49.1 | 0.8 | 715 |
| | 16 | 74.8 | 90.8 | 22.4 | 68.8 | 9.6 | 681 |
| | 17 | 75.2 | 91.2 | 21.2 | 65.4 | 1.4 | 665 |
| | 18 | 75.6 | 91.8 | 18.1 | 60.3 | 3.7 | 1245 |
| | 19 | 75.5 | 90.5 | 17.6 | 58.2 | 5.6 | 501 |
| | 20 | 74.9 | 89.3 | 16.8 | 57.3 | 4.8 | 453 |

The shaded divisions indicate that the data given therein are inferior to the properties of the inventive materials.

TABLE 3

| Material No. | C | Si | Mn | Cr | Ni | V | Nb | Ta | Mo | W | Co | N | B |
|---|---|---|---|---|---|---|---|---|---|---|---|---|---|
| Inventive materials (1) | | | | | | | | | | | | | |
| 1 | 0.12 | 0.05 | 0.65 | 10.2 | 0.68 | 0.21 | 0.05 | — | 0.35 | 2.7 | 3.0 | 0.005 | 0.005 |
| 2 | 0.14 | 0.08 | 0.86 | 10.5 | 0.75 | 0.25 | 0.02 | 0.04 | 0.10 | 3.4 | 3.5 | 0.008 | 0.002 |
| 3 | 0.06 | 0.04 | 0.40 | 8.4 | 0.50 | 0.14 | 0.10 | 0.05 | 0.25 | 2.2 | 4.2 | 0.004 | 0.009 |
| 4 | 0.14 | 0.05 | 0.45 | 9.2 | 0.30 | 0.20 | — | 0.09 | 0.15 | 2.0 | 0.3 | 0.002 | 0.007 |
| 5 | 0.12 | 0.04 | 0.92 | 10.8 | 0.15 | 0.29 | 0.09 | 0.08 | 0.44 | 1.0 | 2.5 | 0.005 | 0.006 |
| Inventive materials (2) | | | | | | | | | | | | | |
| 21 | 0.12 | 0.05 | 0.05 | 9.8 | 0.71 | 0.21 | 0.05 | — | 0.35 | 2.7 | 3.1 | 0.005 | 0.005 |
| 22 | 0.15 | 0.08 | 0.06 | 10.2 | 0.76 | 0.24 | 0.02 | 0.03 | 0.11 | 3.4 | 3.5 | 0.005 | 0.003 |
| 23 | 0.07 | 0.04 | 0.08 | 8.2 | 0.45 | 0.15 | 0.11 | 0.05 | 0.25 | 2.3 | 4.1 | 0.004 | 0.008 |
| 24 | 0.14 | 0.05 | 0.05 | 9.1 | 0.35 | 0.20 | — | 0.10 | 0.16 | 1.9 | 0.5 | 0.003 | 0.006 |
| 25 | 0.13 | 0.04 | 0.06 | 10.5 | 0.16 | 0.28 | 0.07 | 0.08 | 0.43 | 1.1 | 2.4 | 0.006 | 0.006 |

TABLE 4

| Material No. | | Room-temperature tensile test: 0.2% yield strength (kgf/mm$^2$) | Tensile strength (kgf/mm$^2$) | Elongation (%) | Reduction of area (%) | 2 mm V-notched Impact test Impact value (20° C.) (kgf-m) | Creep rupture test Test conditions: 650° C., 18 kgf/mm$^2$ (hours) |
|---|---|---|---|---|---|---|---|
| Inventive materials (1) | 1 | 75.2 | 91.0 | 22.3 | 67.5 | 11.2 | 1652 |
| | 2 | 75.6 | 91.2 | 21.8 | 68.8 | 10.4 | 1826 |
| | 3 | 74.7 | 89.7 | 23.4 | 69.8 | 12.8 | 1675 |
| | 4 | 76.2 | 92.1 | 22.5 | 68.8 | 10.8 | 1250 |
| | 5 | 74.3 | 90.4 | 22.4 | 67.6 | 11.2 | 1604 |
| Inventive materials | 21 | 76.4 | 91.5 | 22.4 | 68.4 | 10.5 | 1820 |
| | 22 | 75.2 | 90.6 | 23.7 | 67.2 | 10.5 | 2001 |

TABLE 4-continued

| Material No. | | Room-temperature tensile test: 0.2% yield strength (kgf/mm$^2$) | Tensile strength (kgf/mm$^2$) | Elongation (%) | Reduction of area (%) | 2 mm V-notched Impact test Impact value (20° C.) (kgf-m) | Creep rupture test Test conditions: 650° C., 18 kgf/mm$^2$ (hours) |
|---|---|---|---|---|---|---|---|
| (2) | 23 | 75.4 | 90.8 | 24.5 | 69.8 | 13.0 | 1725 |
| | 24 | 75.8 | 91.6 | 21.2 | 68.5 | 9.5 | 1320 |
| | 25 | 75.2 | 90.5 | 22.6 | 68.8 | 10.8 | 1811 |

TABLE 5

| Material No. | C | Si | Mn | Cr | Ni | V | Nb | Ta | Mo | W | Co | N | B |
|---|---|---|---|---|---|---|---|---|---|---|---|---|---|
| Inventive materials (1) | | | | | | | | | | | | | |
| 1 | 0.12 | 0.05 | 0.65 | 10.2 | 0.68 | 0.21 | 0.05 | — | 0.35 | 2.7 | 3.0 | 0.005 | 0.005 |
| 2 | 0.14 | 0.08 | 0.86 | 10.5 | 0.75 | 0.25 | 0.02 | 0.04 | 0.10 | 3.4 | 3.5 | 0.008 | 0.002 |
| 3 | 0.06 | 0.04 | 0.40 | 8.4 | 0.50 | 0.14 | 0.10 | 0.05 | 0.25 | 2.2 | 4.2 | 0.004 | 0.009 |
| 4 | 0.14 | 0.05 | 0.45 | 9.2 | 0.30 | 0.20 | — | 0.09 | 0.15 | 2.0 | 0.3 | 0.002 | 0.007 |
| 5 | 0.12 | 0.04 | 0.92 | 10.8 | 0.15 | 0.29 | 0.09 | 0.08 | 0.44 | 1.0 | 2.5 | 0.005 | 0.005 |
| Inventive materials (3) | | | | | | | | | | | | | |
| 31 | 0.13 | 0.05 | 0.63 | 9.8 | 0.05 | 0.21 | 0.04 | — | 0.36 | 2.7 | 3.2 | 0.005 | 0.005 |
| 32 | 0.15 | 0.06 | 0.85 | 10.3 | 0.06 | 0.24 | 0.02 | 0.04 | 0.12 | 3.3 | 3.4 | 0.005 | 0.004 |
| 33 | 0.08 | 0.04 | 0.42 | 8.5 | 0.04 | 0.16 | 0.10 | 0.05 | 0.25 | 2.3 | 4.1 | 0.005 | 0.007 |
| 34 | 0.14 | 0.04 | 0.45 | 9.2 | 0.05 | 0.21 | — | 0.11 | 0.15 | 2.0 | 0.4 | 0.004 | 0.007 |
| 35 | 0.13 | 0.04 | 0.93 | 10.5 | 0.05 | 0.28 | 0.07 | 0.07 | 0.42 | 1.2 | 2.5 | 0.007 | 0.006 |

TABLE 6

| Material No. | | Room-temperature tensile test: 0.2% yield strength (kgf/mm$^2$) | Tensile strength (kgf/mm$^2$) | Elongation (%) | Reduction of area (%) | 2 mm V-notched Impact test Impact value (20° C.) (kgf-m) | Creep rupture test Test conditions: 650° C., 18 kgf/mm$^2$ (hours) |
|---|---|---|---|---|---|---|---|
| Inventive materials (1) | 1 | 75.2 | 91.0 | 22.3 | 67.5 | 11.2 | 1652 |
| | 2 | 75.6 | 91.2 | 21.8 | 68.8 | 10.4 | 1826 |
| | 3 | 74.7 | 89.7 | 23.4 | 69.8 | 12.8 | 1675 |
| | 4 | 76.2 | 92.1 | 22.5 | 68.8 | 10.8 | 1250 |
| | 5 | 74.3 | 90.4 | 22.4 | 67.6 | 11.2 | 1604 |
| Inventive materials (3) | 31 | 76.6 | 92.1 | 23.2 | 68.8 | 11.2 | 1920 |
| | 32 | 74.8 | 90.8 | 22.8 | 67.5 | 9.8 | 2115 |
| | 33 | 75.5 | 91.5 | 22.4 | 67.2 | 12.8 | 1780 |
| | 34 | 74.2 | 90.6 | 23.1 | 68.4 | 9.0 | 1335 |
| | 35 | 75.8 | 91.4 | 21.8 | 67.2 | 11.2 | 1846 |

TABLE 7

| Material No. | C | Si | Mn | Cr | Ni | V | Nb | Ta | Mo | W | Co | N | B |
|---|---|---|---|---|---|---|---|---|---|---|---|---|---|
| Inventive materials (2) | | | | | | | | | | | | | |
| 21 | 0.12 | 0.05 | 0.05 | 9.8 | 0.71 | 0.21 | 0.05 | — | 0.35 | 2.7 | 3.1 | 0.005 | 0.005 |
| 22 | 0.15 | 0.08 | 0.06 | 10.2 | 0.76 | 0.24 | 0.02 | 0.03 | 0.11 | 3.4 | 3.5 | 0.005 | 0.003 |
| 23 | 0.07 | 0.04 | 0.08 | 8.2 | 0.45 | 0.15 | 0.11 | 0.05 | 0.25 | 2.3 | 4.1 | 0.004 | 0.008 |
| 24 | 0.14 | 0.05 | 0.05 | 9.1 | 0.35 | 0.20 | — | 0.10 | 0.16 | 1.9 | 0.5 | 0.003 | 0.006 |

TABLE 7-continued

| Material No. | C | Si | Mn | Cr | Ni | V | Nb | Ta | Mo | W | Co | N | B |
|---|---|---|---|---|---|---|---|---|---|---|---|---|---|
| 25 | 0.13 | 0.04 | 0.06 | 10.5 | 0.16 | 0.28 | 0.07 | 0.08 | 0.43 | 1.1 | 2.4 | 0.006 | 0.006 |
| Inventive materials (4) | | | | | | | | | | | | | |
| 41 | 0.13 | 0.05 | 0.05 | 9.7 | 0.04 | 0.21 | 0.05 | — | 0.33 | 2.6 | 3.1 | 0.005 | 0.005 |
| 42 | 0.15 | 0.07 | 0.05 | 10.5 | 0.06 | 0.24 | 0.02 | 0.04 | 0.11 | 3.5 | 3.4 | 0.006 | 0.004 |
| 43 | 0.08 | 0.04 | 0.07 | 8.4 | 0.07 | 0.16 | 0.10 | 0.05 | 0.24 | 2.3 | 4.1 | 0.005 | 0.007 |
| 44 | 0.13 | 0.06 | 0.05 | 9.1 | 0.05 | 0.21 | — | 0.11 | 0.16 | 1.9 | 0.6 | 0.003 | 0.006 |
| 45 | 0.13 | 0.04 | 0.07 | 10.3 | 0.06 | 0.27 | 0.07 | 0.07 | 0.45 | 1.2 | 2.5 | 0.005 | 0.005 |

TABLE 8

| | | Room-temperature tensile test | | | | 2 mm V-notched | Creep rupture test |
|---|---|---|---|---|---|---|---|
| Material No. | | 0.2% yield strength (kgf/mm$^2$) | Tensile strength (kgf/mm$^2$) | Elongation (%) | Reduction of area (%) | Impact test Impact value (20° C.) (kgf-m) | Test conditions: 650° C., 18 kgf/mm$^2$ (hours) |
| Inventive materials (2) | 21 | 76.4 | 91.5 | 22.4 | 68.4 | 10.5 | 1820 |
| | 22 | 75.2 | 90.6 | 23.7 | 67.2 | 10.5 | 2001 |
| | 23 | 75.4 | 90.8 | 24.5 | 69.8 | 13.0 | 1725 |
| | 24 | 75.8 | 91.6 | 21.2 | 68.5 | 9.5 | 1320 |
| | 25 | 75.2 | 90.5 | 22.6 | 68.8 | 10.8 | 1811 |
| Inventive materials (4) | 41 | 75.8 | 92.4 | 23.2 | 70.1 | 11.2 | 2020 |
| | 42 | 76.3 | 91.3 | 21.4 | 68.8 | 10.7 | 2340 |
| | 43 | 75.7 | 92.6 | 22.2 | 67.2 | 12.8 | 1910 |
| | 44 | 76.4 | 92.7 | 23.6 | 69.5 | 9.4 | 1420 |
| | 45 | 75.2 | 90.4 | 22.5 | 68.4 | 11.5 | 2001 |

TABLE 9

| Material No. | C | Si | Mn | Cr | Ni | V | Nb | Ta | Mo | W | Co | N | B | Nd |
|---|---|---|---|---|---|---|---|---|---|---|---|---|---|---|
| Inventive materials (1) | | | | | | | | | | | | | | |
| 1 | 0.12 | 0.05 | 0.65 | 10.2 | 0.68 | 0.21 | 0.05 | — | 0.35 | 2.7 | 3.0 | 0.005 | 0.005 | — |
| 2 | 0.14 | 0.08 | 0.86 | 10.5 | 0.75 | 0.25 | 0.02 | 0.04 | 0.10 | 3.4 | 3.5 | 0.008 | 0.002 | — |
| Inventive materials (2) | | | | | | | | | | | | | | |
| 22 | 0.15 | 0.08 | 0.06 | 10.2 | 0.76 | 0.24 | 0.02 | 0.03 | 0.11 | 3.4 | 3.5 | 0.005 | 0.003 | — |
| 23 | 0.07 | 0.04 | 0.08 | 8.2 | 0.45 | 0.15 | 0.11 | 0.05 | 0.25 | 2.3 | 4.1 | 0.004 | 0.008 | — |
| Inventive materials (3) | | | | | | | | | | | | | | |
| 33 | 0.08 | 0.04 | 0.42 | 8.5 | 0.04 | 0.16 | 0.10 | 0.05 | 0.25 | 2.3 | 4.1 | 0.005 | 0.007 | — |
| 34 | 0.14 | 0.04 | 0.45 | 9.2 | 0.05 | 0.21 | — | 0.11 | 0.15 | 2.0 | 0.4 | 0.004 | 0.007 | — |
| Inventive materials (4) | | | | | | | | | | | | | | |
| 44 | 0.13 | 0.06 | 0.05 | 9.1 | 0.05 | 0.21 | — | 0.11 | 0.16 | 1.9 | 0.6 | 0.003 | 0.006 | — |
| 45 | 0.13 | 0.04 | 0.07 | 10.3 | 0.06 | 0.27 | 0.07 | 0.07 | 0.45 | 1.2 | 2.5 | 0.005 | 0.005 | — |
| Inventive materials (5) | | | | | | | | | | | | | | |
| 51 | 0.13 | 0.05 | 0.64 | 10.3 | 0.65 | 0.21 | 0.06 | — | 0.34 | 2.7 | 3.0 | 0.005 | 0.005 | 0.050 |
| 52 | 0.14 | 0.07 | 0.86 | 10.6 | 0.74 | 0.24 | 0.03 | 0.04 | 0.10 | 3.3 | 3.4 | 0.005 | 0.003 | 0.003 |
| 53 | 0.14 | 0.08 | 0.07 | 10.4 | 0.76 | 0.24 | 0.02 | 0.04 | 0.10 | 3.4 | 3.5 | 0.005 | 0.003 | 0.108 |
| 54 | 0.07 | 0.05 | 0.08 | 8.3 | 0.44 | 0.15 | 0.11 | 0.05 | 0.25 | 2.2 | 4.0 | 0.004 | 0.007 | 0.094 |
| 55 | 0.08 | 0.04 | 0.43 | 8.4 | 0.04 | 0.14 | 0.11 | 0.05 | 0.24 | 2.3 | 4.1 | 0.005 | 0.007 | 0.154 |
| 56 | 0.13 | 0.05 | 0.44 | 9.2 | 0.06 | 0.21 | — | 0.11 | 0.15 | 2.0 | 0.5 | 0.004 | 0.007 | 0.180 |
| 57 | 0.14 | 0.05 | 0.05 | 9.1 | 0.05 | 0.22 | — | 0.12 | 0.16 | 1.9 | 0.6 | 0.004 | 0.007 | 0.077 |
| 58 | 0.13 | 0.04 | 0.06 | 10.2 | 0.06 | 0.27 | 0.07 | 0.08 | 0.44 | 1.2 | 2.4 | 0.005 | 0.005 | 0.106 |

TABLE 10

| Material No. | | Room-temperature tensile test: 0.2% yield strength (kgf/mm$^2$) | Tensile strength (kgf/mm$^2$) | Elongation (%) | Reduction of area (%) | 2 mm V-notched Impact test Impact value (20° C.) (kgf-m) | Creep rupture test Test conditions: 650° C., 18 kgf/mm$^2$ (hours) |
|---|---|---|---|---|---|---|---|
| Inventive materials (1) | 1 | 75.2 | 91.0 | 22.3 | 67.5 | 11.2 | 1652 |
| | 2 | 75.6 | 91.2 | 21.8 | 68.8 | 10.4 | 1826 |
| Inventive materials (2) | 22 | 75.2 | 90.6 | 23.7 | 67.2 | 10.5 | 2001 |
| | 23 | 75.4 | 90.8 | 24.5 | 69.8 | 13.0 | 1725 |
| Inventive materials (3) | 33 | 75.5 | 91.5 | 22.4 | 67.2 | 12.8 | 1780 |
| | 34 | 74.2 | 90.6 | 23.1 | 68.4 | 9.0 | 1335 |
| Inventive materials (4) | 44 | 76.4 | 92.7 | 23.6 | 69.5 | 9.4 | 1420 |
| | 45 | 75.2 | 90.4 | 22.5 | 68.4 | 11.5 | 2001 |
| Inventive materials (5) | 51 | 76.2 | 92.2 | 20.2 | 65.4 | 10.2 | 1863 |
| | 52 | 75.3 | 91.8 | 21.3 | 66.6 | 9.8 | 1955 |
| | 53 | 74.8 | 90.6 | 22.6 | 64.3 | 9.6 | 2311 |
| | 54 | 75.5 | 91.2 | 21.7 | 65.2 | 11.4 | 1983 |
| | 55 | 75.8 | 91.5 | 20.5 | 66.4 | 11.2 | 2015 |
| | 56 | 75.6 | 91.4 | 20.4 | 63.2 | 8.8 | 1865 |
| | 57 | 76.1 | 92.2 | 21.4 | 63.8 | 9.2 | 1692 |
| | 58 | 75.4 | 91.6 | 21.6 | 64.4 | 10.6 | 2222 |

TABLE 11

| Material No. | C | Si | Mn | Cr | Ni | V | Nb | Ta | Mo | W | Co | N | B | Hf |
|---|---|---|---|---|---|---|---|---|---|---|---|---|---|---|
| Inventive materials (1) | | | | | | | | | | | | | | |
| 1 | 0.12 | 0.05 | 0.65 | 10.2 | 0.68 | 0.21 | 0.05 | — | 0.35 | 2.7 | 3.0 | 0.005 | 0.005 | — |
| 2 | 0.14 | 0.08 | 0.86 | 10.5 | 0.75 | 0.25 | 0.02 | 0.04 | 0.10 | 3.4 | 3.5 | 0.008 | 0.002 | — |
| Inventive materials (2) | | | | | | | | | | | | | | |
| 22 | 0.15 | 0.08 | 0.06 | 10.2 | 0.76 | 0.24 | 0.02 | 0.03 | 0.11 | 3.4 | 3.5 | 0.005 | 0.003 | — |
| 23 | 0.07 | 0.04 | 0.08 | 8.2 | 0.45 | 0.15 | 0.11 | 0.05 | 0.25 | 2.3 | 4.1 | 0.004 | 0.008 | — |
| Inventive materials (3) | | | | | | | | | | | | | | |
| 33 | 0.08 | 0.04 | 0.42 | 8.5 | 0.04 | 0.16 | 0.10 | 0.05 | 0.25 | 2.3 | 4.1 | 0.005 | 0.007 | — |
| 34 | 0.14 | 0.04 | 0.45 | 9.2 | 0.05 | 0.21 | — | 0.11 | 0.15 | 2.0 | 0.4 | 0.004 | 0.007 | — |
| Inventive materials (4) | | | | | | | | | | | | | | |
| 44 | 0.13 | 0.06 | 0.05 | 9.1 | 0.05 | 0.21 | — | 0.11 | 0.16 | 1.9 | 0.6 | 0.003 | 0.006 | — |
| 45 | 0.13 | 0.04 | 0.07 | 10.3 | 0.06 | 0.27 | 0.07 | 0.07 | 0.45 | 1.2 | 2.5 | 0.005 | 0.005 | — |
| Inventive materials (6) | | | | | | | | | | | | | | |
| 61 | 0.13 | 0.06 | 0.65 | 10.3 | 0.65 | 0.21 | 0.05 | — | 0.34 | 2.8 | 3.0 | 0.005 | 0.005 | 0.180 |
| 62 | 0.13 | 0.07 | 0.84 | 10.5 | 0.73 | 0.23 | 0.03 | 0.04 | 0.11 | 3.3 | 3.5 | 0.006 | 0.004 | 0.071 |
| 63 | 0.14 | 0.08 | 0.07 | 10.4 | 0.76 | 0.23 | 0.02 | 0.05 | 0.10 | 3.3 | 3.5 | 0.005 | 0.003 | 0.111 |
| 64 | 0.07 | 0.06 | 0.07 | 8.4 | 0.42 | 0.15 | 0.11 | 0.05 | 0.24 | 2.2 | 4.0 | 0.005 | 0.007 | 0.049 |
| 65 | 0.07 | 0.04 | 0.42 | 8.4 | 0.04 | 0.14 | 0.10 | 0.05 | 0.24 | 2.2 | 4.1 | 0.005 | 0.006 | 0.004 |
| 66 | 0.13 | 0.06 | 0.44 | 9.2 | 0.06 | 0.21 | — | 0.10 | 0.16 | 2.0 | 0.5 | 0.004 | 0.007 | 0.115 |
| 67 | 0.13 | 0.05 | 0.05 | 9.2 | 0.06 | 0.21 | — | 0.12 | 0.16 | 2.0 | 0.5 | 0.003 | 0.008 | 0.090 |
| 68 | 0.13 | 0.04 | 0.06 | 10.2 | 0.06 | 0.27 | 0.07 | 0.08 | 0.43 | 1.2 | 2.4 | 0.005 | 0.005 | 0.157 |

TABLE 12

| Material No. | | Room-temperature tensile test: 0.2% yield strength (kgf/mm$^2$) | Tensile strength (kgf/mm$^2$) | Elongation (%) | Reduction of area (%) | 2 mm V-notched Impact test Impact value (20° C.) (kgf-m) | Creep rupture test Test conditions: 650° C., 18 kgf/mm$^2$ (hours) |
|---|---|---|---|---|---|---|---|
| Inventive materials (1) | 1 | 75.2 | 91.0 | 22.3 | 67.5 | 11.2 | 1652 |
| | 2 | 75.6 | 91.2 | 21.8 | 68.8 | 10.4 | 1826 |
| Inventive materials (2) | 22 | 75.2 | 90.6 | 23.7 | 67.2 | 10.5 | 2001 |
| | 23 | 75.4 | 90.8 | 24.5 | 69.8 | 13.0 | 1725 |
| Inventive materials (3) | 33 | 75.5 | 91.5 | 22.4 | 67.2 | 12.8 | 1780 |
| | 34 | 74.2 | 90.6 | 23.1 | 68.4 | 9.0 | 1335 |
| Inventive materials (4) | 44 | 76.4 | 92.7 | 23.6 | 69.5 | 9.4 | 1420 |
| | 45 | 75.2 | 90.4 | 22.5 | 68.4 | 11.5 | 2001 |
| Inventive materials (6) | 61 | 74.8 | 91.1 | 21.2 | 66.6 | 9.4 | 2166 |
| | 62 | 75.6 | 92.2 | 21.6 | 67.2 | 10.2 | 2122 |
| | 63 | 75.3 | 90.4 | 20.5 | 65.4 | 8.6 | 2461 |
| | 64 | 76.6 | 91.5 | 20.3 | 64.8 | 10.6 | 1988 |
| | 65 | 75.2 | 92.7 | 19.8 | 63.9 | 12.3 | 1894 |
| | 66 | 74.8 | 91.6 | 21.2 | 64.4 | 9.1 | 1782 |
| | 67 | 76.5 | 90.3 | 19.9 | 64.1 | 9.2 | 1881 |
| | 68 | 76.0 | 91.4 | 20.4 | 65.2 | 9.2 | 2544 |

TABLE 13

| Material No. | C | Si | Mn | Cr | Ni | V | Nb | Ta | Mo | W | Co | N | B | Nd | Hf |
|---|---|---|---|---|---|---|---|---|---|---|---|---|---|---|---|
| Inventive materials (1) | | | | | | | | | | | | | | | |
| 1 | 0.12 | 0.05 | 0.65 | 10.2 | 0.68 | 0.21 | 0.05 | — | 0.35 | 2.7 | 3.0 | 0.005 | 0.005 | — | — |
| 2 | 0.14 | 0.08 | 0.86 | 10.5 | 0.75 | 0.25 | 0.02 | 0.04 | 0.10 | 3.4 | 3.5 | 0.008 | 0.002 | — | — |
| Inventive materials (2) | | | | | | | | | | | | | | | |
| 22 | 0.15 | 0.08 | 0.06 | 10.2 | 0.76 | 0.24 | 0.02 | 0.03 | 0.11 | 3.4 | 3.5 | 0.005 | 0.003 | — | — |
| 23 | 0.07 | 0.04 | 0.08 | 8.2 | 0.45 | 0.15 | 0.11 | 0.05 | 0.25 | 2.3 | 4.1 | 0.004 | 0.008 | — | — |
| Inventive materials (3) | | | | | | | | | | | | | | | |
| 33 | 0.08 | 0.04 | 0.42 | 8.5 | 0.04 | 0.16 | 0.10 | 0.05 | 0.25 | 2.3 | 4.1 | 0.005 | 0.007 | — | — |
| 34 | 0.14 | 0.04 | 0.45 | 9.2 | 0.05 | 0.21 | — | 0.11 | 0.15 | 2.0 | 0.4 | 0.004 | 0.007 | — | — |
| Inventive materials (4) | | | | | | | | | | | | | | | |
| 44 | 0.13 | 0.06 | 0.05 | 9.1 | 0.05 | 0.21 | — | 0.11 | 0.16 | 1.9 | 0.6 | 0.003 | 0.006 | — | — |
| 45 | 0.13 | 0.04 | 0.07 | 10.3 | 0.06 | 0.27 | 0.07 | 0.07 | 0.45 | 1.2 | 2.5 | 0.005 | 0.005 | — | — |
| Inventive materials (7) | | | | | | | | | | | | | | | |
| 71 | 0.13 | 0.06 | 0.63 | 10.2 | 0.63 | 0.21 | 0.05 | — | 0.33 | 2.8 | 3.0 | 0.005 | 0.005 | 0.050 | 0.177 |
| 72 | 0.14 | 0.07 | 0.80 | 10.5 | 0.73 | 0.22 | 0.03 | 0.05 | 0.11 | 3.4 | 3.6 | 0.006 | 0.005 | 0.004 | 0.069 |
| 73 | 0.14 | 0.07 | 0.07 | 10.3 | 0.74 | 0.21 | 0.02 | 0.05 | 0.10 | 3.3 | 3.5 | 0.006 | 0.003 | 0.104 | 0.102 |
| 74 | 0.07 | 0.06 | 0.07 | 8.4 | 0.42 | 0.15 | 0.12 | 0.05 | 0.243 | 2.2 | 4.1 | 0.005 | 0.006 | 0.091 | 0.049 |
| 75 | 0.08 | 0.05 | 0.42 | 8.2 | 0.05 | 0.15 | 0.10 | 0.04 | 0.24 | 2.1 | 4.1 | 0.005 | 0.006 | 0.157 | 0.004 |
| 76 | 0.13 | 0.06 | 0.43 | 9.2 | 0.06 | 0.21 | — | 0.10 | 0.16 | 2.0 | 0.5 | 0.004 | 0.007 | 0.175 | 0.115 |
| 77 | 0.14 | 0.05 | 0.05 | 9.1 | 0.05 | 0.22 | — | 0.11 | 0.15 | 2.0 | 0.4 | 0.004 | 0.008 | 0.071 | 0.090 |
| 78 | 0.13 | 0.05 | 0.06 | 10.2 | 0.06 | 0.25 | 0.07 | 0.08 | 0.40 | 1.2 | 2.4 | 0.005 | 0.005 | 0.111 | 0.154 |

TABLE 14

| Material No. | | Room-temperature tensile test: 0.2% yield strength (kgf/mm$^2$) | Tensile strength (kgf/mm$^2$) | Elongation (%) | Reduction of area (%) | 2 mm V-notched Impact test Impact value (20° C.) (kgf-m) | Creep rupture test Test conditions: 650° C., 18 kgf/mm$^2$ (hours) |
|---|---|---|---|---|---|---|---|
| Inventive materials (1) | 1 | 75.2 | 91.0 | 22.3 | 67.5 | 11.2 | 1652 |
| | 2 | 75.6 | 91.2 | 21.8 | 68.8 | 10.4 | 1826 |
| Inventive materials (2) | 22 | 75.2 | 90.6 | 23.7 | 67.2 | 10.5 | 2001 |
| | 23 | 75.4 | 90.8 | 24.5 | 69.8 | 13.0 | 1725 |
| Inventive materials (3) | 33 | 75.5 | 91.5 | 22.4 | 67.2 | 12.8 | 1780 |
| | 34 | 74.2 | 90.6 | 23.1 | 68.4 | 9.0 | 1335 |
| Inventive materials (4) | 44 | 76.4 | 92.7 | 23.6 | 69.5 | 9.4 | 1420 |
| | 45 | 75.2 | 90.4 | 22.5 | 68.4 | 11.5 | 2001 |
| Inventive materials (7) | 71 | 76.8 | 92.4 | 19.8 | 65.3 | 10.2 | 2812 |
| | 72 | 75.2 | 92.3 | 20.0 | 64.7 | 10.6 | 2644 |
| | 73 | 76.4 | 93.0 | 21.3 | 63.8 | 11.4 | 2983 |
| | 74 | 74.8 | 92.4 | 21.4 | 65.5 | 12.5 | 2546 |
| | 75 | 75.0 | 91.0 | 20.2 | 63.6 | 10.6 | 2538 |
| | 76 | 75.4 | 91.8 | 20.8 | 65.2 | 10.1 | 2669 |
| | 77 | 74.4 | 91.3 | 19.6 | 68.4 | 9.8 | 2592 |
| | 78 | 76.9 | 93.2 | 21.8 | 64.8 | 10.6 | 3215 |

We claim:

1. A heat-resisting steel comprising 0.05% to 0.15% by weight of carbon, 0.01 to 0.1% by weight of silicon, 8 to 11% by weight of chromium, 0.1 to 0.3% by weight of vanadium, a total of 0.01 to 0.2% by weight of niobium and tantalum, 0.001 to 0.01% by weight of nitrogen, 0.01 to 0.5% by weight of molybdenum, 0.9 to 3.5% by weight of tungsten, 0.1 to 4.5% by weight of cobalt, 0.001 to 0.01% by weight of boron, further comprising one or more metals selected from the group consisting of:

a) 0.01 to 1% by weight of manganese and 0.1 to 0.8% by weight of nickel;

b) 0.01 to 0.1% by weight of manganese and 0.1 to 0.8% by weight of nickel;

c) 0.01 to 1% by weight of manganese; and d) 0.01 to 0.1% by weight of manganese, and the balance being iron and incidental impurities.

2. A heat-resisting steel according to claim 1 which further comprises 0.001 to 0.2% by weight of neodymium.

3. A heat-resisting steel according to claim 1 which further comprises 0.001 to 0.2% by weight of hafnium.

4. A heat-resisting steel according to claim 3 which further comprises 0.001 to 0.2% by weight of neodymium.

5. A heat-resisting steel according to claim 1, wherein the amount of carbon is 0.08 to 0.13% by weight.

6. A heat-resisting steel according to claim 1, wherein the amount of silicon is 0.03 to 0.08% by weight.

7. A heat resisting steel according to claim 1, wherein the amount of nitrogen is 0.001 to less than 0.01% by weight.

8. A heat resisting steel according to claim 1, wherein the amount of nitrogen is 0.001 to 0.008% by weight.

9. A heat resisting steel according to claim 1, wherein the amount of nitrogen is 0.002 to 0.008% by weight.

10. A method of making a heat-resisting steel, comprising the steps of:

forming a heat-resisting steel comprising 0.05% to 0.15% by weight of carbon, 0.01 to 0.1% by weight of silicon, 8 to 11% by weight of chromium, 0.1 to 0.3% by weight of vanadium, a total of 0.01 to 0.2% by weight of niobium and tantalum, 0.01 to 0.5% by weight of molybdenum, 0.9 to 3.5% by weight of tungsten, 0.1 to 4.5% by weight of cobalt, 0.001 to 0.01% by weight of boron, one or more metals selected from the group consisting of:

a) 0.01 to 1% by weight of manganese and 0.1 to 0.8% by weight of nickel;

b) 0.01 to 0.1% by weight of manganese and 0.1 to 0.8% by weight of nickel;

c) 0.01 to 1% by weight of manganese; and d) 0.01 to 0.1% by weight of manganese, and the balance being iron and incidental impurities; and subjecting the heat-resisting steel to a vacuum treatment to set the nitrogen content of the heat resistant steel to 0.001 to 0.01% by weight.

* * * * *